United States Patent [19]

Edel et al.

[11] 4,408,801

[45] Oct. 11, 1983

[54] ELEVATED SWIVEL CHAIR HAVING A MOVABLE FOOT SUPPORT FOR LOCKING THE CHAIR AGAINST SWIVELING MOTION

[76] Inventors: Hans J. Edel, Wittekindallee 17, D-4950 Minden/West; Helmut Hornung, Karolingerstrasse 9, D-6057 Dietzenbach/West, both of Fed. Rep. of Germany

[21] Appl. No.: 271,305

[22] Filed: Jun. 8, 1981

[30] Foreign Application Priority Data

Jul. 1, 1980 [DE] Fed. Rep. of Germany ..... 3024920

[51] Int. Cl.[3] ..... A47C 7/50

[52] U.S. Cl. ..... 297/433; 248/418

[58] Field of Search ..... 297/423, 433; 248/418; 108/142

[56] References Cited

U.S. PATENT DOCUMENTS

| | | | |
|---|---|---|---|
| 21,469 | 9/1858 | Hartman | 297/433 |
| 2,854,061 | 9/1958 | Romito | 248/418 |
| 4,148,524 | 4/1979 | Guyton | 297/433 |
| 4,369,997 | 1/1983 | Desanta | 297/433 |

*Primary Examiner*—Francis K. Zugel

*Attorney, Agent, or Firm*—Pollock, Vande Sande & Priddy

[57] ABSTRACT

A swivel chair of the type comprising a seat which is supported at an elevated position above a base for swiveling motion relative to the base, and which has a foot support disposed between the base and seat for aiding a user of the chair to ascend to the elevated seat, is provided with clamping elements that are responsive to foot pressure applied to the foot support for preventing swiveling motion of the seat relative to the base when such foot pressure in excess of a predetermined amount is applied. The clamping elements preferably comprise an inclined surface on a bracket that pivotally supports the foot support, and a wedge-shaped element that is disposed between the inclined surface and the pillar of the swivel chair for axial displacement in response to pivotal motion of the foot support resulting from the application of foot pressure thereto.

14 Claims, 5 Drawing Figures

ELEVATED SWIVEL CHAIR HAVING A MOVABLE FOOT SUPPORT FOR LOCKING THE CHAIR AGAINST SWIVELING MOTION

BACKGROUND OF THE INVENTION

The present invention is concerned with elevated swivel chairs having foot supports for aiding a user to ascend to a seated position in the chair, and is more particularly concerned with such a chair wherein the seat portion of the chair is automatically locked against swiveling motion when foot pressure is applied to the foot support.

Elevated swivel chairs, e.g., of the type used as work chairs, must be provided with some means for aiding a user of the chair to ascend to the elevated seat without difficulty. When the user is climbing into the chair, moreover, steps must be taken to assure that the seat portion of the chair does not rotate relative to the base portion thereof; and if a foot support is attached to the upper part of the chair in fixed relation thereto, the total unit consisting of the upper part of the chair and such a foot support must not rotate at the time a worker is ascending into the chair if accidents are to be prevented. These considerations necessitate the use of some type of stop device which can be operated at appropriate times during use of the chair. More particularly, if the chair itself is rotatable, such rotation must be prevented when the user is ascending into the chair to assure that the seat portion of the chair is held stationary during the ascent. After the user is seated, moreover, the stop device must be released so that the user can swing the chair into an appropriate working position whereafter the seat portion of the chair must be locked against rotation to assure that the user sits firmly and securely at a desired work position. If the user wishes to leave the chair, a similar process must be performed, but in reverse order. The plurality of operational steps which must thus be performed tend to become a nuisance at times with the result that users of elevated swivel chair suggested heretofore often omit the manipulations necessary for their personal safety, e.g., they choose not to lock the swivel chair against rotation as they ascend into the chair, and this is the cause of many accidents in manufacturing plants using such chairs.

In this latter respect, elevated work chairs of various types have been suggested heretofore. Such chairs are known, for example, wherein the chair is provided with a base or foot plate, and also wherein foot supports are provided that can be varied in distance from the seat surface; and work chairs are also known wherein foot supports are provided that can be swung selectively into horizontal or vertical position. However all of these various elevated work chairs suggested heretofore have the disadvantages described above.

The present invention is intended to solve these problems by providing an elevated work chair of novel design wherein the chair is automatically locked against rotation when a worker is ascending into or descending from the seat portion of the chair, and wherein the locking operation necessary for the safety of workers occurs without the worker being required to operate any special control elements forming portions of the chair.

SUMMARY OF THE INVENTION

In accordance with the present invention, a swivel chair of the type comprising a base, a tubular pillar on the base, and an upper chair portion or seat supported by the pillar at an elevated position above the base for swiveling motion relative to the base, is provided also with a foot support disposed between the base and the seat for aiding a user of the chair to ascend to or descend from the elevated seat. The foot support is carried by a bracket which is mounted on the pillar for swinging motion about the pillar, and said foot support is adapted to be pivoted relative to said bracket. Stopping means, responsive to pivotal motion of the foot support resulting from the application of foot pressure thereto, automatically lock the seat portion of the chair against rotation. As a result of this arrangement, it becomes impossible for a user of the chair to ascend into the chair by use of the foot support without securing the chair against rotation during the ascent. Moreover, after the user has ascended into the chair, the stopping means can be released by the simple expedient of removing foot pressure from the foot support thereby permitting the user to swivel the chair to any desired position at any time without manipulation of any special adjusting mechanisms, and also permitting the user to relock the swivel chair in any desired rotational position simply by again applying foot pressure to the foot support.

In one preferred embodiment of the invention, the stopping elements employed consist of clamping elements. This has the advantage, among others, that the rotational position of the chair can be continuously selected. Moreover, by the use of clamping elements the amount of clamping force applied can be readily varied by variation of the foot pressure which is supplied to the foot support. The clamping force is highest during the time that a user is ascending into the chair, inasmuch as his entire body weight rests on the foot support; and after the user of the chair is seated in position, he can reduce the clamping force by simply relieving the pressure which is applied to the foot support.

In one embodiment of the invention, the foot support is adapted to be rotated about a horizontal axis on a bracket carried by the pillar of the chair, and the foot support is adapted to be disposed in a substantially horizontal orientation extending radially outward of the pillar, with a portion of the foot support disposed adjacent the pillar being adapted to engage directly or indirectly against a clamping element. This particular design has proved to be especially good in practice. In another embodiment of the invention, the clamping elements take the form of a wedge shaped piece having one surface which engages the chair pillar and another surface which faces a pressure surface on the bracket, with the various surfaces of the wedge-shaped element being displaced into forcible engagement with their facing surfaces in response to pressure on the foot support.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
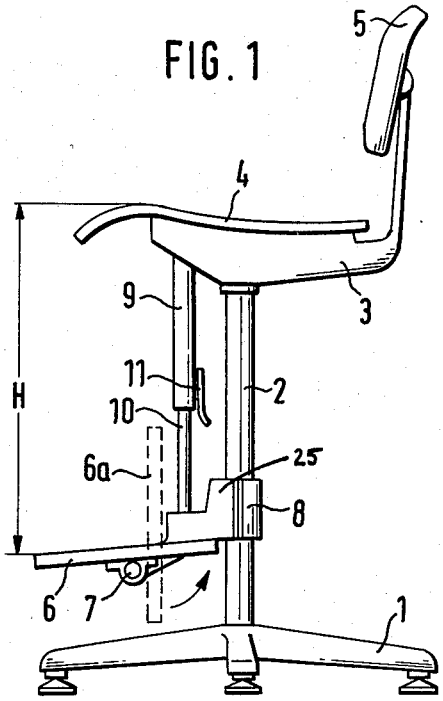
FIG. 1 is a side view of a swivel chair constructed in accordance with the present invention.

Referring initially to FIG. 1, a swivel chair constructed in accordance with the present invention comprises a stationary base 1, a vertically disposed central tubular pillar 2, and an upper chair part 3 provided with a seat surface 4 and a movable back rest 5. A foot support 6 is disposed between base 1 and the seat of the chair by means of a bracket 25 which includes a slideable bearing portion 8 surrounding the pillar 2. The bracket 25 and the foot support 6 carried thereby are adapted to be varied in height above the ground, and are adapted to be mounted for swinging motion about the pillar 2 with rotation of the seat portion 3 of the chair relative to base 1.

Foot support 6 is mounted on bracket 25 for pivotal motion about a horizontal axis 7 which is disposed between the opposing ends of foot support 6. This permits the foot support to be moved between the positions shown in full line and broken line in FIG. 1. When the foot support is in its generally horizontal position (shown in full line in FIG. 1), the portion thereof which is disposed radially outward of axis 7 forms a tread plate 6*a* which is adapted to receive the foot of a user, while the radially inward portion 6*c* of the foot support (see for example FIGS. 2 and 3) is adapted to operate the stopping elements or clamping elements to be discussed hereinafter.

The slide bearing 8 which forms a portion of holder 25 preferably takes the form of two half shells which grip opposing surfaces of the chair pillar 2. A telescopic connection, consisting of a tubular element 9 extending downwardly from the seat 3 in parallel outwardly spaced relation to pillar 2, and a further tubular element 10 extending upwardly from bracket 25 into said socket, is provided between the bracket 25 and seat 3. The telescopic connection 9, 10 includes an adjusting device 11. By operating the adjusting device 11, the distance H between the seat and foot support can be varied as necessary.

Figure 2:
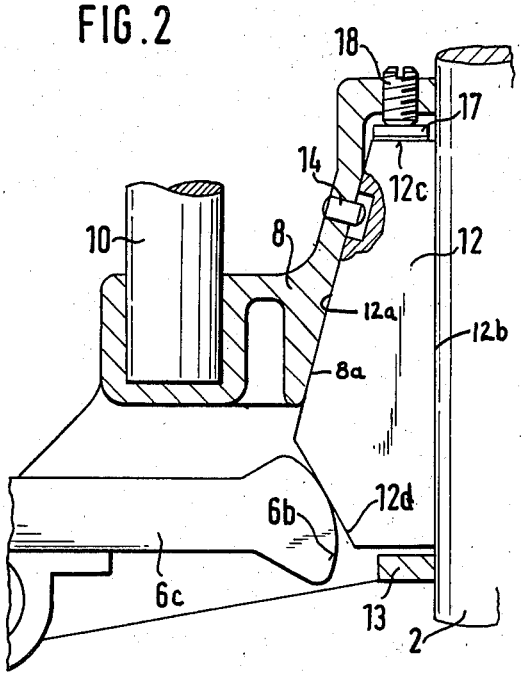
FIG. 2 depicts, partially in section, one form of stopping device constructed in accordance with the present invention.

In the particular embodiment of the present invention shown in FIG. 2, the slide bearing 8 portion of bracket 25 includes an interior conically inclined clamping surface 8*a* which is disposed outwardly of the chair pillar 2 to define an interior wedge-shaped region, and a clamping wedge 12 is disposed in that region for selective axial movement. More particularly, wedge-shaped element 12 includes a conically inclined clamping surface 12*a* which is oriented parallel to clamping surface 8*a* of slide bearing 8, an opposed substantially vertical surface 12*b* which is in sliding engagement with the pillar 2, a horizontal uppermost surface 12*c* which is disposed adjacent a pressure plate 17 that is vertically adjustable by means of an adjusting screw 18, and a lower inclined surface 12*d* that is in engagement with a curved pressure or cam surface 6*b* located at the free end of the radially inward portion 6*c* of foot support 6. The clamping wedge 12 is retained within the aforementioned wedge-shaped region either by means of a flange 13 projecting outwardly from one of the side walls of slide bearing 8 at a position below the lowermost surface of wedge 12, or by means of a securing pin 14 which extends inwardly from slide bearing 8 into an elongated recess in the surface 12*a* of wedge 12, or by both of these retaining arrangements.

In the absence of foot pressure on foot support 6, clamping wedge 12 moves under the influence of gravity into a downward release position which is defined by the position of flange 13 or the interaction between securing pin 14 and the upper end of the recess in clamping surface 12*a*. However when foot pressure is applied to the radially outward portion 6*a* of foot support 6, the radially inward portion 6*c* thereof swings upwardly, and the cam surface 6*b* thereof in engagement with inclined surface 12*d* of wedge 12 causes the wedge to be displaced axially in an upward direction into its clamping position. In this clamping position, surface 12*a* of wedge 12 is in forcible engagement with surface 8*a* of slide bearing 8, surface 12*b* of the wedge is in forcible engagement with the exterior of pillar 2, and surface 12*c* of the clamping wedge is in forcible engagement with pressure plate 17. The engagement between these several surfaces locks bracket 25 against rotation relative to pillar 2 and, due to the interconnection 9, 10 between bracket 25 and seat 3, 4 assures that both the seat and foot support of the swivel chair are held in fixed position and cannot rotate relative to base 1. The clamping position at which this occurs can be varied by means of screw 18 and its associated pressure plate 17.

When foot pressure is released from the foot support 6, the wedge 12 moves axially downward under the influence of gravity to a release position which permits rotation of bracket 25 and foot support 6, as well as seat 3, 4, about chair pillar 2.

Figure 3:
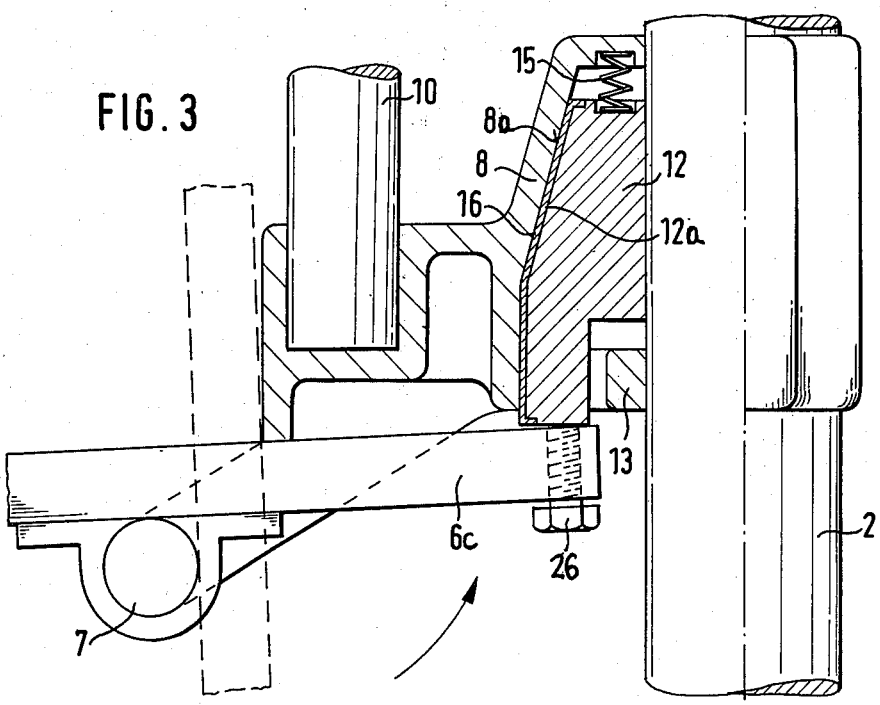
FIG. 3 depicts, partially in section, a second form of stopping device constructed in accordance with the present invention.

The embodiment of FIG. 3 is very similar to that described in reference to FIG. 2, and accordingly like numerals. have been used to designate like parts. In the FIG. 3 embodiment, the horizontal axis 7 is affixed to slide bearing 8 in a fashion somewhat different from that used in FIG. 2, which differences will be apparent from the drawings themselves; the clamping surface 8*a* of slide bearing 8 has a lower substantially vertical portion which merges into an upper conically inclined portion; the wedge-shaped element 12 is given a somewhat different outer configuration complementary with that employed for clamping surface 8*a* and is, in addition, provided with a recess at its bottom for cooperation with the lower positioning flange 13 of slide bearing 8; and the uppermost surface of wedge 12 is provided with a recess in which a pressure spring 15 is seated, functioning to return the wedge 12 to its release position when no foot pressure is applied to foot support 6. In addition, in this embodiment, the radially inward portion 6*c* of foot support 6 extends across the bottom of the clamping wedge 12 so that, when portion 6*c* of the foot support swings upwardly it displaces wedge 12 upwardly against the pressure of spring 15 by a direct pushing action.

The embodiment of FIG. 3 includes two additional features which are not used in the embodiment of FIG. 2. More particularly, the wedge 12 is provided with a slide plate on its clamping surface 8*a* and, in addition, an adjusting screw 26 is threaded through the portion 6*c* of foot support 6 adjacent the free end thereof into engagement with the confronting lower surface of wedge 12. By adjusting screw 26, the angle of inclination of foot support 6, when it is in the general position shown in FIG. 1, can be adjusted.

Figure 5:
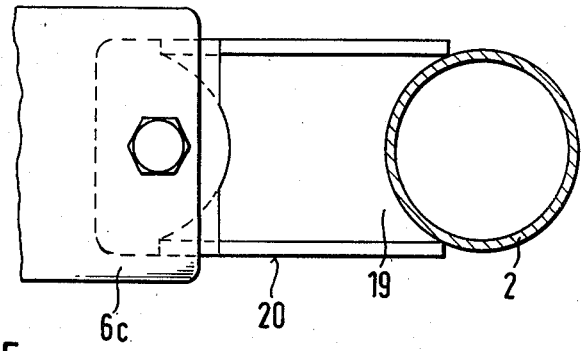
FIG. 5 depicts the device of FIG. 4 as viewed in the direction of arrow V of FIG. 4.
Figure 4:
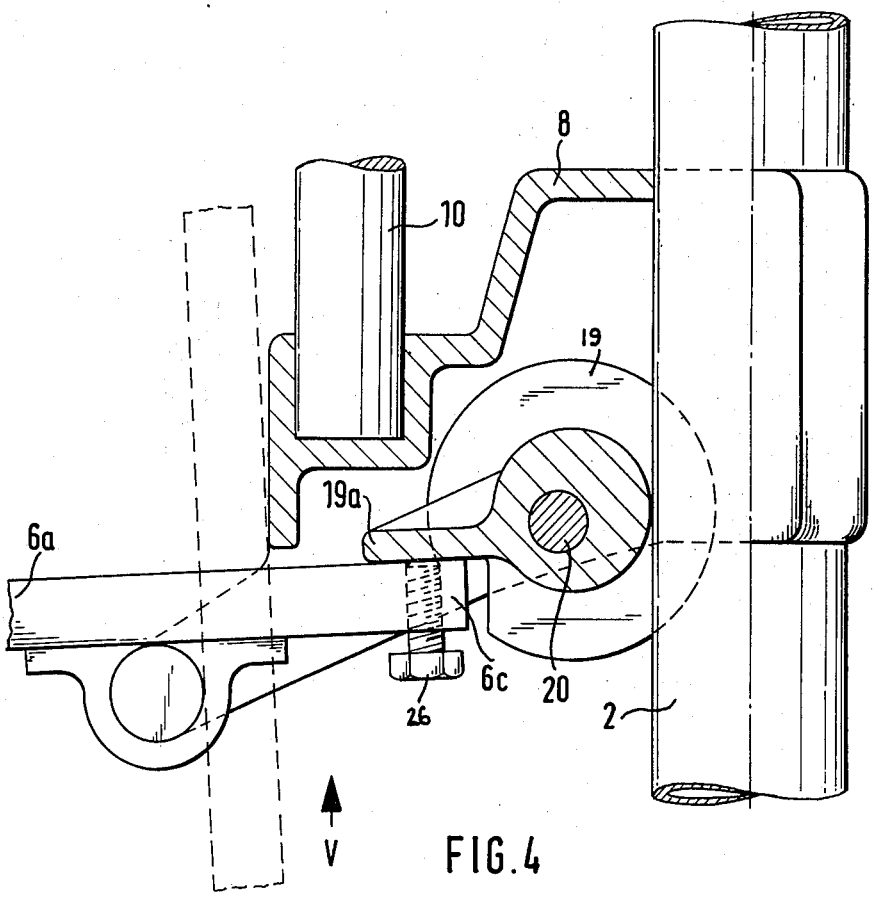
FIG. 4 is a side view, partially in section, of a third form of stopping device constructed in accordance with the present invention.

The embodiment of the invention shown in FIGS. 4 and 5 operates on principles similar to those already described, but instead of using a clamping wedge it employs a clamping cylinder having a clamping cam 19 provided with an eccentric clamping surface. The clamping cam 19 is swingably supported on a horizontal bearing pin 20. A lever portion 19*a* of clamping cam 19 engages the lever zone 6*c* of foot support 6 through an adjusting screw 26 similar to that described in reference to FIG. 3. As a result of this arrangement, the application of foot pressure to the foot support 6 causes the clamping cam 19 to swing into forcible engagement with the exterior of chair pillar 8, thereby preventing rotation of slide bearing 8, foot support 6, and chair 3, 4, relative to pillar 2.

Having thus described our invention, we claim:

1. In a swivel chair of the type comprising a base, a tubular pillar on said base, a seat supported by said pillar at an elevated position above said base for swiveling motion relative to said base, and a foot support disposed between said base and said seat for aiding a user of the chair to ascend to the elevated seat, the improvement wherein a bracket is mounted on said pillar between said base and said seat for swinging motion around said pillar, said foot support being carried by said bracket, and stop means disposed adjacent said bracket and responsive to foot pressure applied to said foot support in excess of a predetermined amount for preventing the swinging motion of said bracket and the foot support carried thereby relative to said pillar.

2. The swivel chair of claim 1 wherein said stop means comprises clamping elements which are free to move relative to one another in the absence of said foot pressure, and which are moved into forcible engagement with one another upon application of said foot pressure.

3. The swivel chair of claim 2 wherein said foot support is oriented substantially radially relative to said pillar and is mounted on said bracket for pivotal motion about a horizontal axis that is located between the inner and outer ends of the foot support, the portion of the foot support radially outward of said axis being adapted to receive said foot pressure to effect pivotal motion about said axis of said foot support, the pivotal motion of the portion of said foot support radially inward of said axis being operative to move said clamping elements into forcible engagement with one another.

4. The swivel chair of claim 3 wherein said clamping elements comprise a surface on said bracket which is spaced outwardly of said pillar, and an axially displaceable element disposed in spaced relation to said surface and in sliding engagement with said pillar, said radially inward portion of said foot support being disposed adjacent said element and being adapted, upon said pivotal motion thereof, to displace said element axially relative to said pillar into forcible clamping engagement with said surface.

5. The swivel chair of claim 4 wherein said bracket includes a conically inclined surface spaced outwardly of said pillar, said axially displaceable element being wedge shaped and having a vertical surface which is in sliding engagement with the outer surface of said pillar and an opposing inclined surface which faces said inclined surface of said bracket.

6. The swivel chair of claim 5 including spring means for moving said wedge shaped element to a release position in the absence of said foot pressure.

7. The swivel chair of claim 6 including means for supporting said wedge shaped element at its said release position.

8. The swivel chair of claim 5 including a slide plate mounted on said inclined surface of said wedge shaped element.

9. The swivel chair of claim 5 including means for adjusting the clamping position of said wedge shaped element.

10. The swivel chair of claim 9 wherein said adjusting means comprises a pressure plate adjacent the uppermost surface of said element, and an adjusting screw supported by said bracket and engaging said pressure plate to vary the position of said plate relative to said uppermost surface of said element.

11. The swivel chair of claim 5 wherein the free end of the radially inward portion of said foot support has a curved cam surface which is adapted to bear against a further inclined surface at the lower end of said wedge shaped element to effect said axial displacement of said element.

12. The swivel chair of claim 4 including an adjusting screw in the portion of said foot support that is disposed adjacent said element for varying the inclination of said foot support about said horizontal axis.

13. The swivel chair of claim 1 including means for vertically adjusting the position of said bracket relative to said pillar thereby to adjust the height of said foot support above said base.

14. The swivel chair of claim 13 wherein said adjusting means includes a pair of telescoping elements disposed outwardly of and parallel to said pillar between said bracket and said seat.

* * * * *